United States Patent [19]

Grant et al.

[11] Patent Number: 4,490,427

[45] Date of Patent: Dec. 25, 1984

[54] ADHESIVE WEBS AND THEIR PRODUCTION

[75] Inventors: Eric M. Grant, Elland; John E. Walker, Halifax, both of England

[73] Assignee: Firma Carl Freudenberg, Weinheim an der Bergstrasse, Fed. Rep. of Germany

[21] Appl. No.: 434,473

[22] Filed: Oct. 15, 1982

[30] Foreign Application Priority Data

Jun. 14, 1982 [GB] United Kingdom ..... 8217167

[51] Int. Cl.[3] ..... B32B 5/08

[52] U.S. Cl. ..... 428/107; 428/109; 428/110; 428/113; 428/212; 428/213; 428/288; 428/292; 428/294; 428/296; 428/340

[58] Field of Search ..... 428/114, 198, 288, 293, 428/296, 294, 340, 914, 292, 107, 109, 110, 212, 213

[56] References Cited

U.S. PATENT DOCUMENTS

| | | | |
|---|---|---|---|
| 3,449,187 | 6/1969 | Bobhowicz | 428/293 |
| 4,304,234 | 12/1981 | Hartmann | 428/292 |
| 4,440,819 | 4/1984 | Rosser et al. | 428/257 |

*Primary Examiner*—James J. Bell

*Attorney, Agent, or Firm*—Kenyon & Kenyon

[57] ABSTRACT

This application discloses adhesive webs and their production. The thermally adhesive webs of this application are comprised of substantially parallel fusible polymeric filaments thermally bonded to and interconnected by randomly arranged polymeric fibers. The web may be comprised of co-, ter-, or higher polyesters or polyamides, such as a terpolymer or nylon 6, 66 and 12. The parallel filaments may comprise about 20 to 80% by weight of the web and the interconnecting fibers 80 to 20% of the web, with the weight of the web being about 10 g/m$^2$ to below about 80 g/m$^2$. The web may be in the form of a tape.

11 Claims, No Drawings

ADHESIVE WEBS AND THEIR PRODUCTION

BACKGROUND OF THE INVENTION

There is described in British Patent Specification No. 1,117,751 the production of thermally adhesive webs comprising a tissue of randomly arranged fusible filaments. The webs are useful as thermal adhesives in various textile and interlining applications. They are lightweight webs, typically weighing from 20 to 50 g/m$^2$. Because the webs are so thin and light they have rather low tensile strength. It is often desired to use the web in the form of a tape but because of the low tensile strength, and because of difficulties in handling the tape, especially using high speed mechanical handling apparatus, it is necessary to ensure that the tape is not too narrow, as otherwise it will break during handling. Typically the minimum width is 13 mm or more.

Despite these difficulties the thermally adhesive webs have been widely used and have come to be recognized as important materials.

DETAILED DESCRIPTION OF THE INVENTION

A thermally adhesive web according to the present invention comprises substantially parallel fusible filaments, thermally bonded to, and interconnected by, fusible fibers.

The interconnecting fusible fibers are preferably provided in the form of a tissue of randomly arranged fusible fibers. The interconnecting fibers preferably are filaments, i.e. substantially endless fibers.

The substantially parallel filaments that are interconnected by the randomly arranged filaments or other interconnecting fibers are preferably arranged in rectilinear fashion. As a result it is possible to cut the web in the form of a tape with the parallel filaments extending along the length of the tape. Although the tape can be of conventional width (13 to 50 mm or more) and advantage of the invention is that the tape can be narrower than has previously been satisfactory, without increase in fiber weight. Thus, the tape can easily be less than 13 mm in width and typically can be 3 to 6 mm in width.

The total weight of the web can be similar to the total weight of conventional thermally adhesive webs, generally above 10 g/m$^2$ but below 80 g/m$^2$, preferably 20 to 50 g/m$^2$. The web is generally a highly porous network consisting only of the fusible parallel filaments and the fusible interconnecting filaments or other fibers.

The parallel filaments generally provide from 20 to 80% of the web weight, with the interconnecting filaments or other fibers providing the remaining 80 to 20% by weight. For most purposes the parallel filaments provide 30 to 70% by weight. Webs formed of from 30 to 50% by weight parallel filaments and 70 to 50% by weight interconnecting filaments or other fibers are generally preferred for most textile and interlining applications, but for uses where maximum permeability and/or maximum longitudinal strength are required webs containing from 70 to 80% by weight of the parallel filaments may be preferred.

The parallel filaments generally have a diameter substantially greater than the diameter of the interconnecting filaments or other fibers. The parallel filaments may be provided by individiual mono-filaments or by groups of filaments in contact with one another. The spacing between adjacent parallel filaments is generally from 0.5 to 5 mm with best results generally being obtained with spacings of 1 to 3 mm, preferably about 2 mm. It is generally desired that the spacing between filaments should be substantially uniform and constant but some variations may occur during manufacture and are tolerable. If the web is to be cut into a tape it is necessary that the tape should contain a plurality of the parallel filaments. For instance if the tape is 6 mm wide the filaments must not be more than 2 or 3 mm apart, so as to ensure that the tape contains at least 2 or 3 of the filaments.

The filaments and the interconnecting fibers may be of the same or different polymeric materials. Polymeric materials will generally have a melting point below 150° C., generally 80° to 120° C. The polymeric materials are generally co-, ter- or higher-polymers of polyamides or polyesters, for instance a terpolymer of nylon 6, 66 and 12.

The web is generally supplied to the user unsupported, for instance as a reel, but if desired may be supplied to the user while supported on a release paper.

The web may be made by collecting onto a carrier the parallel filaments and the tissue or other interconnecting filaments and fusing the filaments and interconnecting fibers. Preferably the fusion occurs during collection as a result of the parallel filaments or the interconnecting fibers being in a fully fused or partially fused state at the time of collection. The tissue may be made by extruding filaments and stretching them while molten, preferably by the action of gas streams emerging from apertures close to the extrusion orifices, which are preferably arranged in a straight row, as described in British Patent Specification No. 1,117,751 which is incorporated herein by reference. The carrier onto which the tissue is collected is normally 8 to 25, most usually around 15, cm below the extrusion orifices. The filaments are deposited on the carrier in a substantially random manner, generally while they are still partially fused but after they have been drawn substantially while as individual filaments by the gas streams.

The parallel filaments are laid on the carrier or the tissue and preferably this is achieved by extruding the filaments directly onto the carrier or tissue. Preferably the filaments or the tissue are still partially fused when they contact one another but if necessary the web may be heated in order to improve thermal bonding of the parallel filaments to the tissue.

The extrusion of the filaments onto the carrier or tissue is preferably conducted by extrusion through a straight row of orifices positioned close to the carrier, the orifices typically being from 0.5 to 3, and preferably about 1, cm above the carrier. The orifices can be single orifices or they can be provided in the form of groups, for instance as described in British Patent Specification No. 1,178,438, which is incorporated herein by reference. Preferably the carrier is drawn away from the orifices at a speed faster than the speed of the filaments as they approach the carrier, with the result that the filaments are stretched upon contact with the carrier and they maintain their parallel configuration. If desired the filaments may additionally be stretched by gas streams emerging close to the extrusion orifices, but these gas streams must not be such as to create so much turbulence adjacent the carrier that the parallel configuration of the filaments is destroyed.

The thermally adhesive webs of the invention have improved tensile strength compared to the conventional webs, free of the parallel fusible filaments. It is therefore possible to produce a web of the same fiber weight but having improved tensile strength or it is possible to reduce the fiber weight and maintain the tensile strength, compared to known webs. The webs can be cut as narrower tapes and can be unwound from reels at faster speed than has previously been permissible.

Air permeability is improved and so either the same degree of permeability can be achieved with a higher fiber weight or the fiber weight can be maintained constant and the air permeability improved.

The following is an example of the invention.

A thermally adhesive web is formed weighing 40 $g/m^2$ and formed of 20 $g/m^2$ parallel filaments and 20 $g/m^2$ interconnecting filaments, all the filaments being formed of a terpolymer of nylon 6, 66 and 12. The parallel filaments are spaced 2 mm apart.

The web is made using apparatus similar to that described in British Patent Specification No. 1,117,751 except that 2 linear spinnerets are used and the web is not heated sufficiently to destroy the filamentary structure.

In particular, the terpolymer is extruded through a row of orifices 2 mm apart onto a carrier positioned about 1 cm below the orifices and is stretched by being drawn away by the carrier upon impact.

The tissue is formed over the parallel filaments by extrusion through a second linear spinneret positioned about 15 cm above the carrier, the filaments being stretched by air streams emerging from slots close to and parallel to the row of orifices. The filaments are still partially fused upon impact with the carrier and the continuous filaments are collected randomly on the carrier. The web may then be heated and pressed sufficiently to improve the thermal bonding of the parallel filaments to the tissue.

The resultant web may then be stripped from the carrier and wound onto reels, and may be split into tape 6 mm wide either before or after the winding.

While specific embodiments of the invention have been described with particularity herein, it should be understood that this invention is intended to cover all changes and modifications of the embodiments of the invention chosen herein for purposes of illustration which do not constitute departures from the spirit and scope of the present invention.

I claim:

1. A thermally-adhesive tape consisting essentially of a plurality of rectilinearly-oriented substantially parallel fusible polymeric filaments evenly spaced across the width of said tape, said filaments being thermally bonded to, and interconnected by, randomly-arranged polymeric fusible filaments, said randomly-arranged filaments having diameters substantially less than the diameters of said parallel filaments.

2. The thermally adhesive web according to claim 1 wherein said fusible filaments and fusible fibers are comprised of the same or different polymers selected from the group consisting of co-, ter- or higher polyamides or polyesters.

3. The thermally adhesive web according to claim 2 wherein said web is comprised of a terpolymer of nylon 6, 66 and 12.

4. The thermally adhesive web according to claims 1, 2 or 3 wherein the parallel filaments comprise about 20 to about 80% by weight of the web and the interconnecting fibers comprise about 80% to about 20% by weight of the web, the weight of said web is about 10 to below about 80 $g/m^2$, and said web is in the form of a tape having a width of from about 3 mm to less than about 13 mm.

5. The thermally adhesive web according to claim 4 wherein the spacing between the parallel filaments is substantially constant and about 0.5 to about 5 mm, and the weight of said web is about 20 to about 50 $g/m^2$.

6. The thermally adhesive web according to claim 5 wherein said spacing is about 2 mm.

7. The thermally adhesive web according to claim 4 wherein the parallel filaments comprise about 30% to about 70% of said web.

8. The thermally adhesive web according to claim 7 wherein the parallel filaments comprise about 30 to about 50% of said web, and the interconnecting fibers comprise about 70% to about 50% of said web.

9. The thermally adhesive web according to claim 1 or 2 wherein the filaments and interconnecting fibers are comprised of the same or different polymeric materials having a melting point of from about 80° C. to below about 150° C.

10. The thermally adhesive web according to claim 9 wherein said melting point is from about 80° C. to about 120° C.

11. The thermally adhesive web according to claim 9 supported on release paper.

* * * * *